US006764301B2

(12) United States Patent
Paleno et al.

(10) Patent No.: US 6,764,301 B2
(45) Date of Patent: Jul. 20, 2004

(54) COMBINATION GAS CYLINDER STRIKER AND WRENCH DEVICE

(75) Inventors: Michael L. Paleno, 6 Delaware Crest, Dingmans Ferry, PA (US) 18328; Daniel T. Pirl, Jr., Dingmans Ferry, PA (US)

(73) Assignee: Michael L. Paleno, Dingmans Ferry, PA (US)

( * ) Notice: Subject to any disclaimer, the term of this patent is extended or adjusted under 35 U.S.C. 154(b) by 53 days.

(21) Appl. No.: 10/167,146

(22) Filed: Jun. 11, 2002

(65) Prior Publication Data

US 2003/0190572 A1 Oct. 9, 2003

Related U.S. Application Data

(63) Continuation-in-part of application No. 10/117,770, filed on Apr. 5, 2002.

(51) Int. Cl.[7] ..... F23Q 1/02; B25F 1/00

(52) U.S. Cl. ..... 431/253; 431/274; 81/437; 7/138; 29/513; 76/119

(58) Field of Search ..... 431/273–276, 431/253; 81/437; 7/138; 29/513; 76/119

(56) References Cited

U.S. PATENT DOCUMENTS 10,159 A * 10/1853 Gleason ..... 277/470
13,134 A * 6/1855 Wiler et al. ..... 431/253
27,971 A * 4/1860 Gleason ..... 431/253
140,191 A * 6/1873 Damarin et al. ..... 431/253
1,584,422 A * 5/1926 Bate ..... 81/124.3
1,678,399 A * 7/1928 Larsen ..... 431/146
2,727,375 A * 12/1955 Hobing ..... 431/273
3,314,087 A * 4/1967 Green ..... 7/139
3,858,258 A * 1/1975 Stevens ..... 7/129
5,538,418 A * 7/1996 Stinnett ..... 431/253

* cited by examiner

*Primary Examiner*—Ira S. Lazarus
*Assistant Examiner*—James G. Barrow
(74) *Attorney, Agent, or Firm*—Roger M. Rathbun

(57) ABSTRACT

A combination gas cylinder striker and wrench device for use with a gas cylinder having a cylinder valve with a valve stem. The device is made of a striker having a pair of wire frame members that are manipulatable to strike a spark for igniting a flammable gas from a gas cylinder. A gas cylinder wrench is affixed to one of the wire frame members. The gas cylinder wrench has a central portion having an opening therethrough that is sized to interfit with the valve stem of the gas cylinder. The central portion is located at a U-shaped area of the wire frame member to stabilize the affixation of the gas cylinder wrench to the wire frame member.

20 Claims, 3 Drawing Sheets

COMBINATION GAS CYLINDER STRIKER AND WRENCH DEVICE

CROSS REFERENCE TO RELATED APPLICATIONS

The present application is a continuation-in-part application based upon U.S. Ser. No. 10/117,770, filed Apr. 5, 2002 and entitled "COMBINATION GAS CYLINDER STRIKER AND WRENCH DEVICE".

BACKGROUND OF THE INVENTION

The present invention relates to gas cylinders and, more particularly, to an improved combination device that combines a striker for igniting the gas from the cylinder with a cylinder wrench for operating the cylinder valve.

There are, of course, a considerable number of uses for gas cylinders containing a combustible gas, and, in general, the gas is acetylene and the gas is connected to a torch unit that is used for a wide variety of purposes, such as welding, soldering and the like and in a wide range of fields. As is conventional, the gas cylinder is fitted with a valve having a rotatable valve stem that is used to turn the gas on and off and the stem has a external end that is formed in a particular configuration so as to be operable by a corresponding specially shaped wrench. A common configuration is that the valve stem has a generally square shaped outer end and, therefore, the cylinder wrench has a square shaped opening that operates that valve by the interfitting of the opening in the external end of the valve stem. Without the valve wrench, obviously, the user is unable to rotate the valve stem to operate the valve of the gas cylinder and, therefore, is basically unable to carry out whatever operation or use is desired for the torch.

As such, one of the drawbacks of the present gas cylinder and torch systems is in that the cylinder wrench must remain accessible at all times for the user to be able to use that cylinder wrench as needed. With the conventional cylinder wrench, the geometry of the cylinder wrench is a flat, relatively planar metallic unit and, if the cylinder wrench were dropped it can be difficult to locate or to even realize that the cylinder wrench is missing. With the geometry and shape of the conventional cylinder wrench, that issue of misplacing the wrench is exacerbated if the cylinder wrench is dropped in a cluttered area such as a dirty area or where the illumination is relatively dim.

Another conventional component used with flammable gas systems is a striker and which basically is a device that strikes a spark that enables the user to ignite the flammable gas at the torch. While there are a number of differing designs of strikers, one common striker design is comprised of a single wire formed into a coil with two wire frame members extending outwardly from the coil such that the wire frame members have free ends that can be moved relative to each other with a springing action provided by the coil arrangement.

At the free end of one of the wire frame members, there is an enclosed striker cup lined with a specific material and at the free end of the other wire frame member, there is provided with another specific material. When the user flexes the striker frame members so as to move the two free ends relative to each other, the two materials at those free ends are caused to rub against each other to produce a spark that is, in turn, used to ignite the flammable gas that is emanating from the torch so as to light that torch. As a feature of the aforedescribed striker, however, the shape and configuration of the striker is unusual, more of a three dimensional shape than the normal flat cylinder wrench and therefore is easier to locate if inadvertently dropped or misplaced than the conventional cylinder wrench. Thus, as described, the striker is also an important and necessary component of the torch system and its accessibility is also necessary for the use of that torch.

Accordingly, it would be advantageous to have a cylinder wrench that would be part of some component that is more easily identifiable, three dimensional and therefore, easier to locate if inadvertently dropped or mislaid.

SUMMARY OF THE INVENTION

Therefore, in accordance with the present invention, there is provided a specially constructed combination of a cylinder wrench and a striker so as to take advantage of certain of the features of both devices.

With the present invention, therefore, the cylinder wrench, normal a flat, planar device is combined with a striker that has an unusual profile and configuration and therefore the combination device is less likely to become lost or, if dropped, it is more likely to be readily located in most environments than if only a conventional cylinder wrench is present.

In the present invention, a specially designed cylinder wrench is constructed and used and which is affixed to a striker that is basically a conventional striker having a pair of wire frame members. The overall device is a unique combination of a striker, with the normal functions of a striker, as well as a cylinder wrench along with the normal functions of a cylinder wrench.

In one embodiment of the invention, the cylinder wrench is basically a body comprising a raised boss having an opening that is configured so as to interfit with the external end of the valve stem of a gas cylinder. A flange extends from the raised boss and has a pair of outwardly extending arms that extend from the raised boss in opposite directions from the raised boss. At or near the extended free ends of the arms are affixing surfaces, that is, there are bendable wings and raised edges that are comprised of a relatively bendable material that allows the wings and the raised edges to be bent around one of the wire frame members of the conventional striker.

To make the affixation of the cylinder wrench of the present invention to a striker, it is preferred that the wings and the raised edges meet at an angle with respect to each other so that the wire frame member can be initially nested in the angled surface and the wings and raised edges bent around that wire frame member. As a further preferred feature, the conventional striker also has a U-shaped indentation in the wire frame members and the present cylinder wrench has the raised boss specially dimensioned and configured so as to fit with the U-shaped indentation of the wire frame member in a force fit to hold the cylinder wrench securely in position affixed to the wire frame member of the striker.

As an alternate embodiment, the cylinder wrench may be constructed of a generally U-shaped metal stamping that has two free arms of a bendable material that are also U-shaped and wherein those arms can be bent around one of the wire frame members to secure the wrench to the striker. Again in this embodiment, use is preferable made of the U-shaped indentation that is normally present in the striker such that a pair of flanges that are also formed as a part of the U-shaped stamping are positioned so as to straddle one of the U-shaped indentions in the striker frame member, that is, the flanges sandwich the U-shaped indention therebetween.

At least one of the flanges has an opening that is configured so as to interfit with the external end of the valve stem of a gas cylinder.

Other features of the combination device will become apparent in light of the following detailed description of a preferred embodiment thereof and as illustrated in the accompanying drawings.

DETAILED DESCRIPTION OF THE INVENTION

Figure 1:
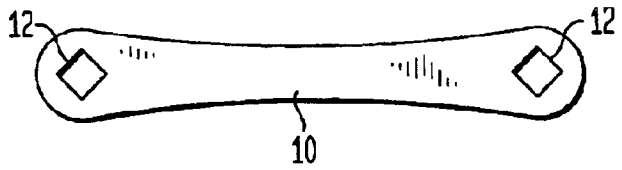
FIG. 1 (PRIOR ART)
FIG. 1 is a top plan view of a conventional, currently used, cylinder wrench.

Referring now to FIG. 1, there is shown a top plan view of a conventional cylinder wrench 10 of the type that is commonly used with gas cylinders containing a flammable gas for use with a torch. As can be seen, the cylinder wrench 10 has an opening 12 formed in each end thereof and which are specially sized so as to fit to a external end of a valve stem for a conventional flammable gas cylinder in order to open and close that valve in using the gas cylinders supplying that gas to a torch.

As its typical of such conventional cylinder wrenches 10, the body of the wrench is basically a flat, planar construction and therefore can be easily be lost if dropped in many environments that are cluttered, dirty and/or in a dim illumination.

Figure 2:
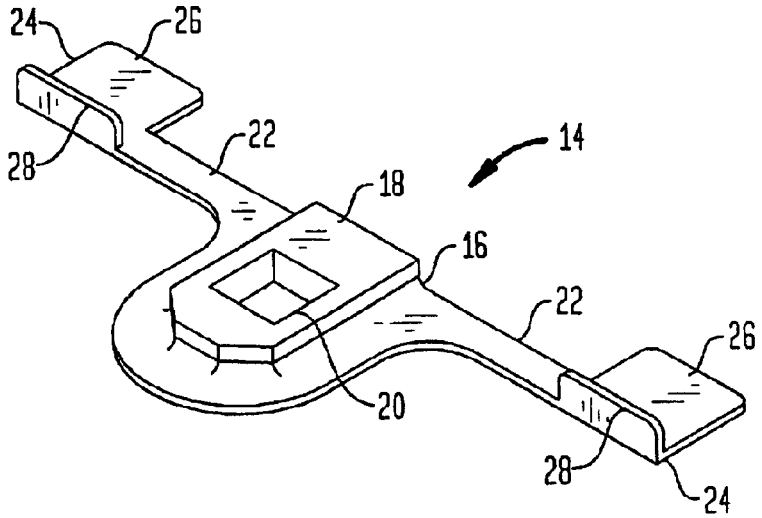
FIG. 2 is a perspective view of the cylinder wrench component of the present combination device.

Turning now to FIG. 2, there is shown, a perspective view of a cylinder wrench 14 constructed in accordance with the present invention. In this Figure, there is a main body 16 that is preferable constructed of a stamped metal and which has a raised boss 18 that provides a strengthened area and which has an opening 20 formed therein. As explained, the opening 20 is configured so as to interfit with the external end of a valve stem of a cylinder valve for the flammable gas. Thus, the opening 20, in the preferred embodiment, is shown and which interfits with a square valve stem for operating that cylinder valve.

As also can be seen in FIG. 2, the main body 16 is thinner surrounding the opening 20 and the raised boss 18 and includes arms 22 that extend outwardly in opposite directions from the raised boss 18 to form free ends 24. At or near each of the free ends 24 there is formed a wing 26 and a raised edge 28. In the preferred embodiment, each wing 28 and raised edge 28 meet at an angle, shown as about a right angle, in FIG. 2, however, the angle may be greater or smaller as long as there is formed some angled junction between a wing 26 and raised edge 28 so that a wire frame member (not shown in FIG. 2) can rest in that junction in the affixing the cylinder wrench 14 to a striker (not shown in FIG. 2).

Figure 3:
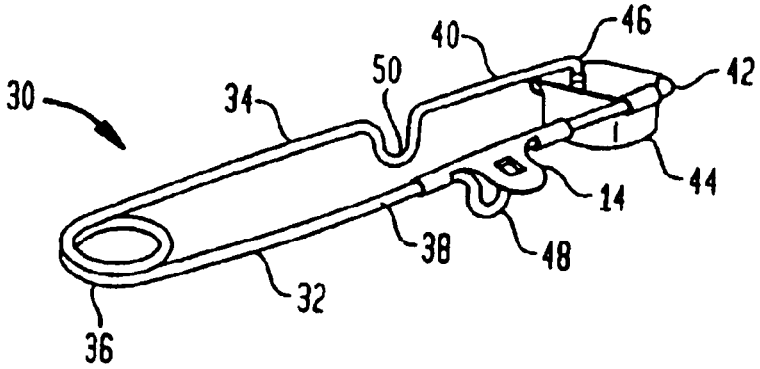
FIG. 3 is a perspective view of a combination device of the present invention.

Turning now to FIG. 3, there is shown a perspective view of a combination device 30 that combines the cylinder wrench 14 constructed in accordance with the present invention and affixed to a striker 32. The striker 32 itself is a conventional device used to generate a spark in order to ignite the flammable gas to light a torch supplied by a cylinder of such gas. The striker 32 is basically constructed of a frame 34 comprising a wire, generally of steel, that has a coil 36 that provides a springing action to the wire frame members 38, 40. Thus the frame 34 can be comprised of a single wire or there may be a plurality of individual wires, it only being of importance that there be some spring means that creates a springing action with respect to the relative motion between the wire frame members 38, 40.

At the free end 42 of the wire frame member 38, there is affixed a striker cup 44 that has a material formed on the inner surface and a free end 46 of the other wire frame member 40 extends into the striker cup 44 end contacts that inner surface of striker cup 44. By means of the particular materials formed on the inner surface of the striker cup 44 and the material formed on the free end 46, as the free end 46 is moved against the springing action imposed by the coil 36, the free end 46 of the wire frame member 40 moves frictionally along the inner surface of the striker cup 44, and that frictional movement between the striker frame members 38, 40 cause a rubbing of those materials and produces a spark.

As also can be seen in FIG. 3, there is formed in each of the wire frame members 38, 40 U-shaped indentations 48,50 and which are normally formed in conventional strikers 32. In general, the U-shaped indentations 48, 50 are located about mid way between the coil 36 and the free ends 42, 46 of the wire frame members 38 and 40. There can also be seen a cylinder wrench 14 constructed as described with respect to FIG. 2 and affixed to the wire frame member 38.

That affixation can be seen with reference to FIG. 2 and can be seen that each wing 26 and raised edge 28 meet at the aforedescribed angle so that the wire frame member 38 can be placed at the apex of that angle and the raised edge 28 initially deformed so as to curl around the wire frame member 38 and thereafter, the wing 26 can be deformed so as to encircle the deformed raised edge 28 so as to finish off the affixing of the cylinder wrench 14 to the wire frame member 38. Thus, the deformation of the raised edge 28 and the wing 26 create an encircling of the frame 34 around the wire frame member 38 to secure the cylinder wrench 14 to that wire frame member 38.

Figure 4A:
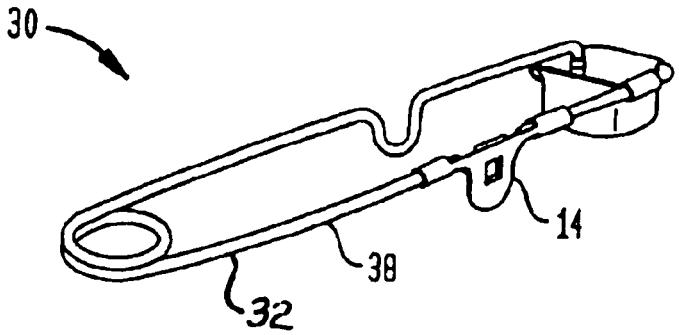
FIGS. 4A and 4B are perspective views of the completed combination device constructed in accordance with the present invention
Figure 4B:
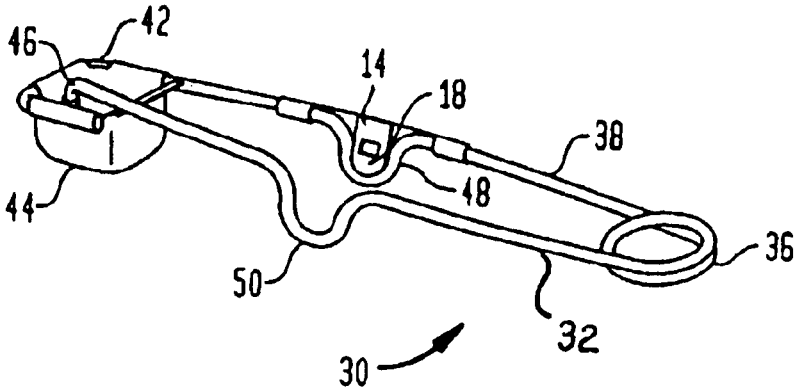

Turning now to FIGS. 4A and 4B, there is shown perspective views of the present combination device 30 taken from opposed sides. In FIGS. 4A and 4B, the cylinder wrench 14 of the present invention is shown in its final position affixed to the wire frame member 38 and where the curved profile of the raised boss 18 fits in an interference or forced fit within the U-shaped indentation 48 so that the cylinder wrench 14 is firmly mounted in position affixed to the striker 32 and does not move from that fixed position.

Thus, as particularly seen in FIG. 4B, the raised boss 18 is nestled within and tightly secured to the U-shaped indentation 48 formed in the wire frame member 38, that is, preferably the wire frame member 38 that does nor freely move as the wire frame members 38, 40 are squeezed together since the wire frame member 38 has the striker cup 44 affixed thereto and the other wire frame member 40 is more readily movable since its free end 46 is movable within the striker cup 44 in creating the spark.

Figure 5:
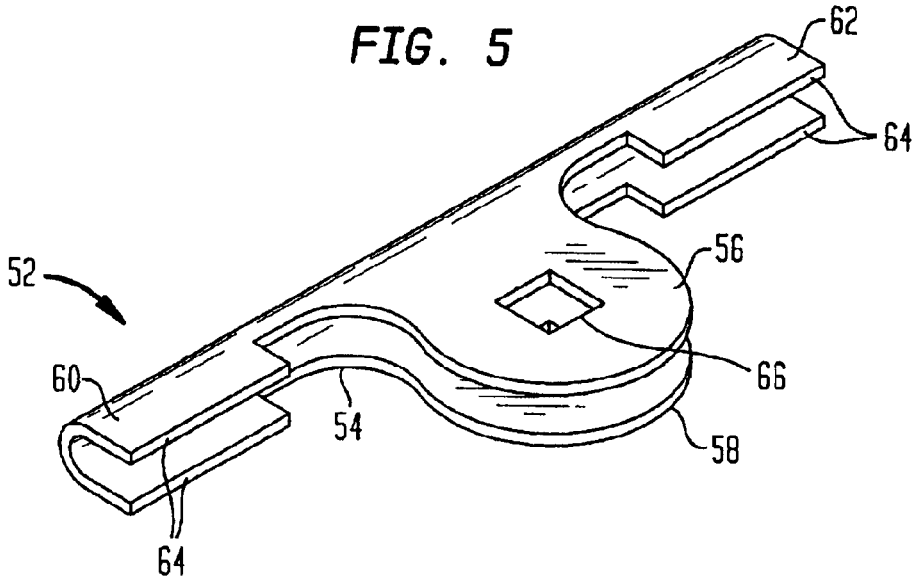
FIG. 5 is a perspective view of another embodiment of the cylinder wrench component of the present invention.

Turning now to FIG. 5, there is shown a perspective view of a further embodiment of a cylinder wrench 52 constructed in accordance with the present invention. In this embodiment, the cylinder wrench 52 is a metal stamping that has been bent to form a U-shaped body 54 with radius of the bend being approximately the same, but slightly larger, than the radius of the wire frame members 38, 40 as shown in FIG. 3. In FIG. 5, it can be seen that the U-shaped body 54 comprises a pair of centrally located flanges 56, 58 and a pair of wings 60, 62, with each of the wings 60, 62 having, due to the U-shape of the body 54, two bendable free ends 64.

It can also be seen that at least one of the centrally located flanges 56, 58 has an opening 66 formed therein and which, as in the prior embodiment, is shaped so as to receive therein the stem of a cylinder valve.

Figure 6:
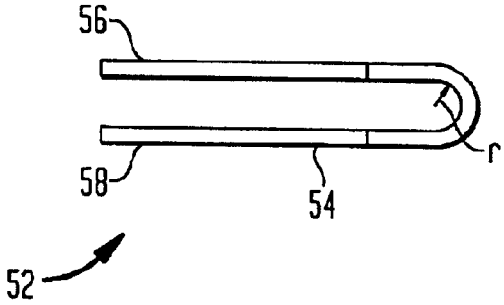
FIG. 6 is a side view of the component of FIG. 3.

Turning now to FIG. 6, there is shown an end view of the cylinder wrench 52 of FIG. 5 and showing the radius "r" of the arcuate bend that is formed by bending the metal stamping into the U-shaped body 54.

Figure 7:
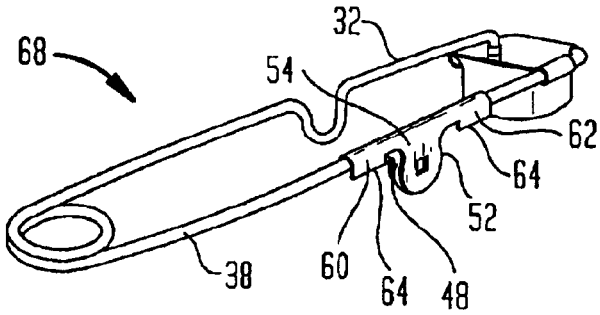
FIG. 7 is a perspective view of the combination device of the present invention using the cylinder wrench component of FIG. 5.

Finally, turning to FIG. 7, there is a perspective view of the combination device 68 with the cylinder wrench 52 of this embodiment affixed to a striker 32. In affixing the cylinder wrench 52 to the striker 32, the U-shape body 54 is slipped over the wire frame member 38 and the free ends 64 of the wings 60, 62 are bent around the wire frame member 38 so as to tightly enclose that wire frame member 38 and hold the cylinder wrench 52 firmly to the wire frame member 38.

It is also an aid in the firm affixation of the cylinder wrench 52 to the wire frame member 38 of the striker 32 that the radius "r" of FIG. 6 is approximately the same or slightly larger than the radius of the wire frame member 38 so that the wire frame member 38 fits tightly into that arcuate area or "U" of the U-shaped body 54.

In order to prevent the cylinder wrench from slipping or rotating with respect to the wire frame member 38, once affixed thereto, the centrally located flanges 56, 58 are located so as to be on either side of the U-shaped indentation 48, that is, the U-shaped indentation in the wire frame member 38 is sandwiched between the centrally located flanges 56, 58 to prevent the rotation of the cylinder wrench 52 with respect to that wire frame member 38.

It will be understood that the scope of the invention is not limited to the particular embodiment disclosed herein, by way of example, but only by the scope of the appended claims.

We claim:

1. A combination device for operation of a gas cylinder having a valve stem, said combination device comprising a striker having wire frame members, said wire frame members being manipulatable so as to create a spark upon relative movement between said wire members, a cylinder wrench affixed to one of said wire frame members, said cylinder wrench having an opening formed therein adapted to interfit with the valve stem to operate said gas cylinder.

2. A combination device as defined in claim 1 wherein said cylinder wrench comprises a main body having a raised boss and a pair of ends extending outwardly in opposite directions from said raised boss, each of said ends constructed of a bendable material.

3. A combination device as defined in claim 1 wherein said cylinder wrench comprises a U-shaped body having a pair of centrally located flanges and wings extending outwardly therefrom, said wings each having free ends constructed of a bendable material.

4. A combination device as defined in claim 3 wherein said U-shaped body is formed having a radius, and wherein said radius is approximately the same or slightly larger than the radius of said one of said wire frame members such that said one of said wire frame members fits tightly into the U-shaped body.

5. A combination device as defined in claim 4 wherein said U-shaped body is a metal stamping.

6. A combination device as defined in claim 2 wherein said one of said wire frame members has U-shaped indentation.

7. A combination device as defined in claim 6 wherein said raised boss fits into said U-shaped indentation.

8. A combination device as defined in claim 7 wherein said raised boss fits in a force fit within said U-shaped indentation so as to be retained position within said U-shaped indentation.

9. A combination device as defined in claim 3 wherein said one of said wire frame members has U-shaped indentation.

10. A combination device as defined in claim 9 wherein said centrally located flanges fit over said U-shaped indentation to sandwich the U-shaped indentation between said centrally located flanges.

11. A cylinder wrench adapted to be affixed to a wire frame member of a striker, said wrench comprising a central portion having an opening therethrough, said wrench having arms extending outwardly in opposite directions ending in free ends, and said arms having wings extending outwardly at or near the free ends thereof, said wings being comprised of a material that is readily bendable so as to encircle a wire frame member of a striker to affix the wrench to the wire frame member.

12. A cylinder wrench as defined in claim 11 wherein said central portion comprises a raised boss section having an opening of predetermined configuration formed therein.

13. A cylinder wrench as defined in claim 11 wherein said central portion comprises a pair of spaced apart flanges and wherein at least one of said flanges has an opening of predetermined configuration formed therein.

14. A method of constructing a combination device for use in operating a valve stem of a gas cylinder, said method comprising the steps of:

providing a striker for producing a spark having a pair of wire frame members, providing a cylinder wrench for interfitting to the valve stem for operating the gas cylinder, affixing the cylinder wrench to one of the pair of wire frame members.

15. A method of constructing a combination device as defined in claim 14 wherein said step of providing a striker comprises providing a stalker having an indentation formed in one of the wire frame members.

16. A method of constructing a combination device as defined in claim 15 wherein said step of providing a cylinder wrench comprises providing a cylinder wrench having a body with a raised boss and having arms extending outwardly therefrom.

17. A method of constructing a combination device as defined in claim 16 wherein said step of affixing the cylinder wrench to one of said wire frame member comprises inserting the raised boss of the cylinder wrench forcibly into the indentation.

18. A method of constructing a combination device as defined in claim 14 wherein said step of affixing the cylinder wrench to one of the wire frame members comprises bending the arms around the wire frame member.

19. A method of constructing a combination device as defined in claim 15 wherein said wherein said step of providing a cylinder wrench comprises providing a cylinder wrench having a pair of centrally located spaced apart flanges.

20. A method of constructing a combination device as defined in claim 19 wherein said step of affixing the cylinder wrench to one of the wire frame members comprises locating the pair of centrally located spaced apart flanges to sandwich the indentation formed in one of the wire members.

* * * * *